US011407607B2

(12) United States Patent
Sarkissian

(10) Patent No.: US 11,407,607 B2
(45) Date of Patent: Aug. 9, 2022

(54) DISPENSER

(71) Applicant: George Sarkissian, Glendale, CA (US)

(72) Inventor: George Sarkissian, Glendale, CA (US)

( * ) Notice: Subject to any disclaimer, the term of this patent is extended or adjusted under 35 U.S.C. 154(b) by 459 days.

(21) Appl. No.: 16/523,912

(22) Filed: Jul. 26, 2019

(65) Prior Publication Data

US 2020/0031602 A1 Jan. 30, 2020

Related U.S. Application Data

(60) Provisional application No. 62/703,789, filed on Jul. 26, 2018.

(51) Int. Cl.
*B65H 35/00* (2006.01)
*B65H 16/00* (2006.01)

(52) U.S. Cl.
CPC ..... *B65H 35/0026* (2013.01); *B65H 16/005* (2013.01)

(58) Field of Classification Search
None
See application file for complete search history.

(56) References Cited

U.S. PATENT DOCUMENTS 4,267,949 A * 5/1981 Hemgren ..... B26F 3/002 225/106
5,294,068 A * 3/1994 Baro ..... B26F 3/02 206/405
5,814,184 A * 9/1998 Denkins ..... B65H 35/0033 156/577
6,235,369 B1 * 5/2001 Shepard ..... D04H 11/00 428/85
6,789,594 B1 * 9/2004 Yu Chen ..... B65H 35/0026 156/523
8,083,114 B1 * 12/2011 Steele ..... B65H 35/0026 225/20
2005/0006423 A1 * 1/2005 Kjeldsen ..... B65H 75/22 225/47
2014/0263528 A1 * 9/2014 Ormerod ..... B65H 35/008 225/77
2015/0265037 A1 * 9/2015 Foreman ..... B65H 49/205 224/665
2020/0270086 A1 * 8/2020 Jones ..... B65H 16/103

* cited by examiner

*Primary Examiner* — William A. Rivera
(74) *Attorney, Agent, or Firm* — Lowry Blixseth APC; Scott M. Lowry

(57) ABSTRACT

The dispenser may include a housing that includes an inner cavity for select reception and retention of a tape ribbon. A cap may be movable between a closed position to enclose the inner cavity and the tape ribbon therein and an open position providing access to the tape ribbon in the inner cavity of the housing. Furthermore, the dispenser may also include a dispense channel having a size and shape for selectively dispensing the tape ribbon out from within the inner cavity when the cap is in the closed position. Moreover, a safety wall may extend outwardly from the dispense channel and form an enclosure shielding opposite sides of a free end of the tape ribbon extending through the dispense channel, while permitting front on hand access of the free end for continued select dispensing.

23 Claims, 13 Drawing Sheets

DISPENSER

BACKGROUND OF THE INVENTION

The present invention generally relates to a dispenser. More specifically, the present invention relates to a dispenser for a tape ribbon that includes a housing to store the tape ribbon, an outlet for dispensing a piece of tape, and an enclosure bounded by a set of safety walls that generally shields a sharp free end of the tape ribbon during non-use and transportation to help prevent injury.

Metal tape is typically manufactured and sold as a rolled coil stock and is stored and shipped in a generic four or six-sided cardboard box. FIG. 1, e.g., is an exemplary embodiment of one such four-sided prior art cardboard box 20. The cardboard box 20 is designed to be temporarily used for shipping, and is otherwise not designed for subsequent use as a storage container or carrier while on a job site. To use, a user typically opens the cardboard box 20 by opening the various sides as illustrated in FIG. 2 to expose a rolled coil stock tape ribbon 22 therein. The tape ribbon 22 can then be removed and used while on the job site. The cardboard box 20 is then typically discarded as waste, and the user must cart the exposed tape ribbon 22 from location-to-location at a job site. This practice presents numerous limitations for which there are no known practical solutions.

For example, once the cardboard box 20 is opened, it is difficult to put the cardboard box 20 back together, making the cardboard box 20 inconvenient for reuse. Moreover, continued reuse necessarily requires repeatedly disassembling and reassembling the cardboard box 20, which may result in degradation over time given that cardboard materials forming the housing of the cardboard box 20 are not designed for such repeat use. One alternative is that the user could retrofit the cardboard box 20 by pulling a free end 24 of the tape ribbon 22 through a slot or the like (unnumbered in FIGS. 1 and 2) where two sides of the cardboard box 20 meet, but the cardboard box 20 is not designed for such use either (regardless whether said use is one time or repeated). Moreover, the tape ribbon 22 may have one or more sharp edges, and the exposed free end 24 of the tape ribbon 22 could easily cut the user's fingers, hands, arms, etc. as a result of accidental contact therewith. Furthermore, the cardboard box 20 can get dusty and/or wet with use, which is bad for cleanliness and the integrity of the tape ribbon 22 over extended or longer-term use. Also, the tape ribbon 22 can be damaged if it bends after being removed from the cardboard box 20, and can be especially problematic when used in construction zones. Ultimately, the use of the cardboard box 20 as a storage container for the tape ribbon 22 poses numerous limitations and is at least inconvenient, if not potentially a safety hazard.

Another drawback is that the cardboard box 20 and the tape ribbon 22 are not designed to fasten to the user, such as for purposes of portability. As shown in FIGS. 1 and 2, the cardboard box 20 and the tape ribbon 22 do not include a carrying handle or the like. So, a user moving about a space in a large work area must necessarily carry the cardboard box 20 and/or the tape ribbon 22 from location to location at a job site, and set them down when not in use. Obviously, when working in tight spaces, the user does not have the tape ribbon 22 readily at hand. Moreover, when commonly used in construction zones, the unprotected tape ribbon 22 may be undesirably damaged when set down because it is no longer protected by the housing of the cardboard box 20. Also, users who frequently use ladders may find use of the cardboard box 20 and/or the tape ribbon 22 extremely inconvenient. At a minimum, requiring the user to hold one of the cardboard box 20 or the tape ribbon 22 while climbing a ladder reduces safety because the user necessarily cannot hold the ladder with two hands.

There exists, therefore, a significant need for a dispenser for a tape ribbon that includes a dispenser housing for storing the tape ribbon, a designated dispensing outlet for dispensing a piece of ribbon tape, and at least one safety wall that generally shields a sharp free end of the tape ribbon within an enclosure to help prevent injury. The present invention fulfills these needs and provides further related advantages.

SUMMARY OF THE INVENTION

In one embodiment, the dispenser as disclosed herein may include a housing having an inner cavity for select reception and retention of a tape ribbon. A cap may be movable between a closed position enclosing the inner cavity and an open position providing access to the inner cavity in the housing. The dispenser may also include a dispense channel having a size and shape for selectively dispensing the tape ribbon out from within the inner cavity when the cap is in the closed position. Moreover, a safety wall may extend outwardly from the dispense channel and form an enclosure shielding opposite sides of a free end of the tape ribbon extending through the dispense channel, while permitting front on hand access of the free end for continued select dispensing.

More specifically, the safety wall may include a pair of outwardly extending and oppositely facing safety walls on each side of the dispense channel that cooperate with an outer sidewall of the housing having the dispense channel formed therein to generally form a three sided-pocket comprising the enclosure. The dispense channel may include an upper guide offset from a lower wedge by a distance relatively larger than a material thickness of the tape ribbon to permit unwinding removal of the tape ribbon out from within the inner cavity, wherein the lower wedge may include a ledge about which a portion of the tape ribbon may be bent for storage of the free end within the enclosure during non-use.

A lower base plate of the housing may cooperate with an upstanding and generally circular-shaped inner sidewall positioned to an interior of an upstanding and generally circular-shaped outer sidewall to form the inner cavity in the housing, the lower wedge may extend outwardly away from the outer sidewall and include an integrated cutting edge, the housing may include a handle for carrying the tape ribbon within the tape dispenser, and the dispenser may also include a lock for retaining the cap in the closed position relative to the housing.

More specifically, the lock may include a pair of T-shaped channels formed from each of the housing and the cap and keyed for linear alignment when the cap is in the closed position such that a slide lock having a reciprocal structure for at least partially encompassing the T-shaped channels can move between a first unlocked position whereby the slide lock is in a generally non-overlapping position with at least one of the T-shaped channels and a second locked position whereby the slide lock is in a generally overlapping position with respect to both of the locking channels. Moreover, the dispenser may also include at least one radially outwardly extending elongated window formed from the housing or the cap to permit viewing of the inner cavity when the cap is in the closed position. Additionally, these embodiments may also include a base having a pair of feet downwardly extending therefrom to provide support for purposes of standing the dispenser in a generally vertical or upright position during non-use.

In another aspect of these embodiments, the cap may include at least one accessory receptacle configured to engage a generally U-shaped slot of an accessory compartment and include a circumferential lip having a size and shape for engagement with a circumferential notch in an outer sidewall of the housing when the cap is in the closed position. Moreover, the housing may include a belt loop that includes a pair of angled extenders outwardly extending from a rear surface of the housing and terminating in a generally horizontally positioned base plate interconnecting the angled extenders and forming a through channel underneath to accommodate slide through reception of a belt.

In another embodiment as disclosed herein, the dispenser may include a housing configured for select reception and retention of a tape ribbon and a cap movable between a closed position enclosing the tape ribbon within the housing and an open position providing access to the tape ribbon in the housing. Here, the cap may include a circumferential lip having a size and shape for engagement with a circumferential notch in the outer sidewall of the housing when the cap is in the closed position. Furthermore, the dispenser may include a dispense channel that includes a guide offset from a wedge by a distance relatively larger than a material thickness of the tape ribbon, thereby permitting unwinding removal of the tape ribbon out from within the housing through the dispense channel when the cap is in the closed position.

Additionally, a pair of outwardly extending and oppositely facing safety walls on each side of the dispense channel may cooperate with an outer sidewall of the housing having the dispense channel formed therein to generally form a three sided-pocket shielding opposite sides of a free end of the tape ribbon extending through the dispense channel, while permitting front on hand access of the free end for continued select dispensing. The wedge may extend outwardly away from the outer sidewall and include an edge about which a portion of the tape ribbon may be bent for storage within the three-sided pocket during non-use. Moreover, a lower base plate of the housing may cooperate with an upstanding and generally circular-shaped inner sidewall positioned to an interior of the upstanding and generally circular-shaped outer sidewall to form an inner cavity for retaining the tape ribbon within the housing.

In another aspect of these embodiments, the dispenser may include a lock having a pair of T-shaped channels formed from each of the housing and the cap and keyed for linear alignment when the cap is in the closed position. Here, a slide lock having a reciprocal structure that may at least partially encompass the T-shaped channels can move between a first unlocked position whereby the slide lock is in a generally non-overlapping position with at least one of the T-shaped channels and a second locked position whereby the slide lock is in a generally overlapping position with respect to both of the locking channels.

In another alternative embodiment, the dispenser may include a housing for selectively storing and dispensing a tape ribbon therefrom, a cap movable relative to the housing between an open position and a closed position where a lip of the cap engages a notch in an outer sidewall of the housing, a dispense channel having a size and shape for selectively dispensing the tape ribbon from the housing when the cap is in the closed position, a safety wall extending outwardly from the dispense channel and forming an enclosure shielding opposite sides of a free end of the tape ribbon extending through the dispense channel, while permitting front on hand access of the free end for continued select dispensing, and a lock comprising a pair of channels formed in each of the housing and the cap and keyed for linear alignment with one another when the cap is in the closed position such that a slide is movable between a first unlocked position in generally non-overlapping relation with respect to at least one of the pair of channels and a second locked position whereby the slide generally overlaps each of the pair of locking channels.

Alternatively, the safety wall may include a pair of outwardly extending and oppositely facing safety walls on each side of the dispense channel, which may include an upper dispensing guide offset from a lower dispensing wedge by a distance relatively larger than a material thickness of the tape ribbon, to permit unwinding removal of the tape ribbon out from within the housing and that cooperates with the outer sidewall of the housing having the dispense channel formed therein to generally form a three sided-pocket that includes the enclosure.

Additionally, the lower dispensing wedge may include a ledge about which a portion of the tape ribbon may be bent for storage of the free end within the enclosure during non-use and a lower base plate of the housing may cooperate with an upstanding and generally circular-shaped inner sidewall positioned to an interior of the outer sidewall to form an inner cavity in the housing. Moreover, the lower dispensing wedge may extend outwardly away from the outer sidewall, the cap may include at least one accessory receptacle configured to engage a generally U-shaped slot of an accessory compartment that includes at least a nutsetter carrier, and the housing may include a handle for carrying the tape ribbon within the tape dispenser and a belt loop that includes a pair of angled extenders outwardly extending from a rear surface of the housing and terminating in a generally horizontally positioned base plate interconnecting the angled extenders and forming a through channel underneath to accommodate slide through reception of a belt.

In another embodiment as disclosed herein, the dispenser may include a housing for storing a tape ribbon, a cap for sealing the tape ribbon within the housing, a dispensing outlet to direct the smooth flow of tape ribbon out from within the dispenser, a handle and a belt loop for ergonomic grasping or attachment to clothing, and a set of safety walls to generally shield a sharp free end of the tape ribbon that may cause injury or damage. The safety walls may be generally formed parallel and flush with the housing and an annular plate in the cap parallel to the housing. The safety walls may also protrude radially from the housing and include fillets to maximize hand safety. To this end, the safety walls may provide a location for the free (and sharp) end to reside, and provide relatively easy fingertip or hand access to the internally positioned free end by way of a recess formed into the safety walls.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
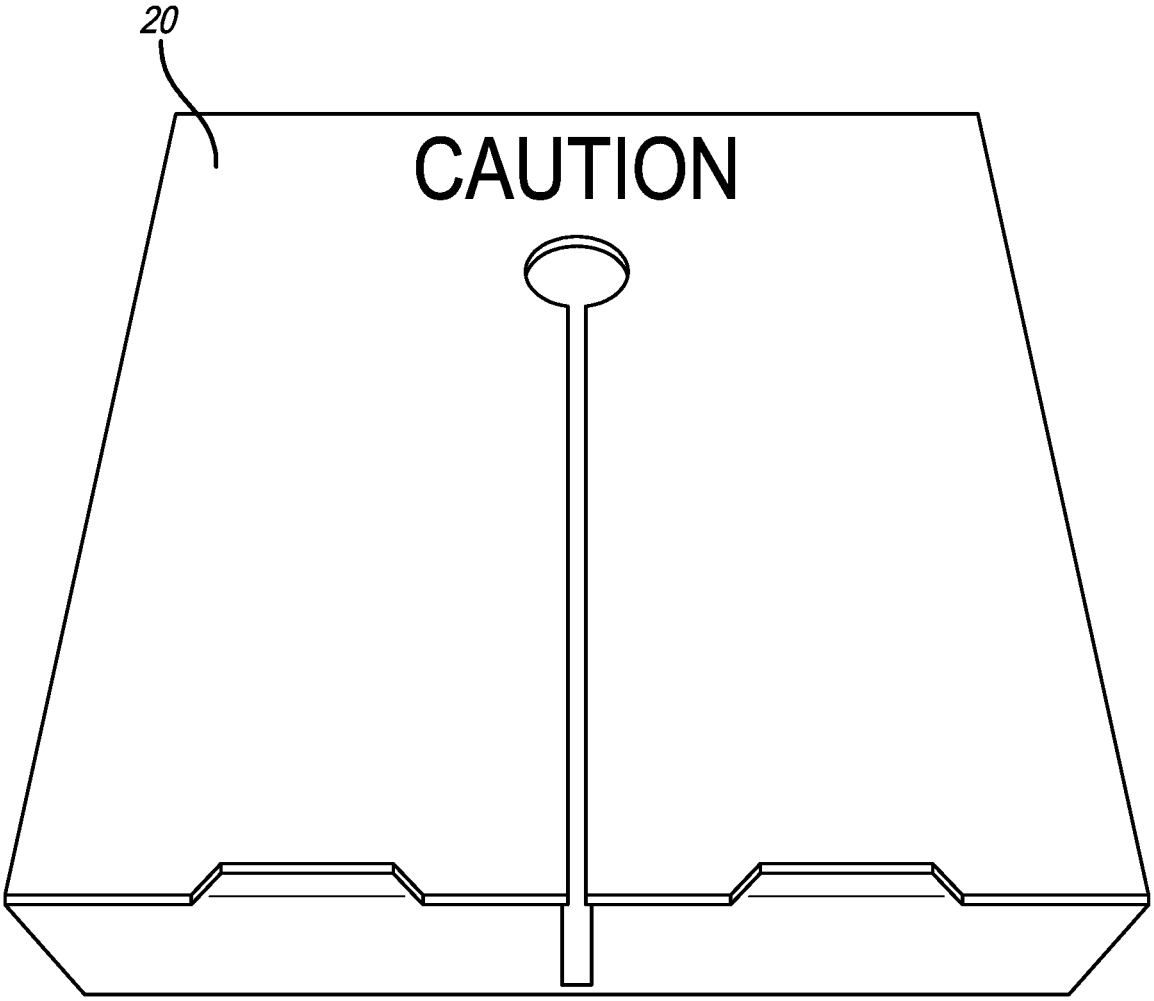
FIG. 1 PRIOR ART
FIG. 1 is a perspective view of a prior art cardboard box used to store and ship a tape ribbon.
Figure 2:
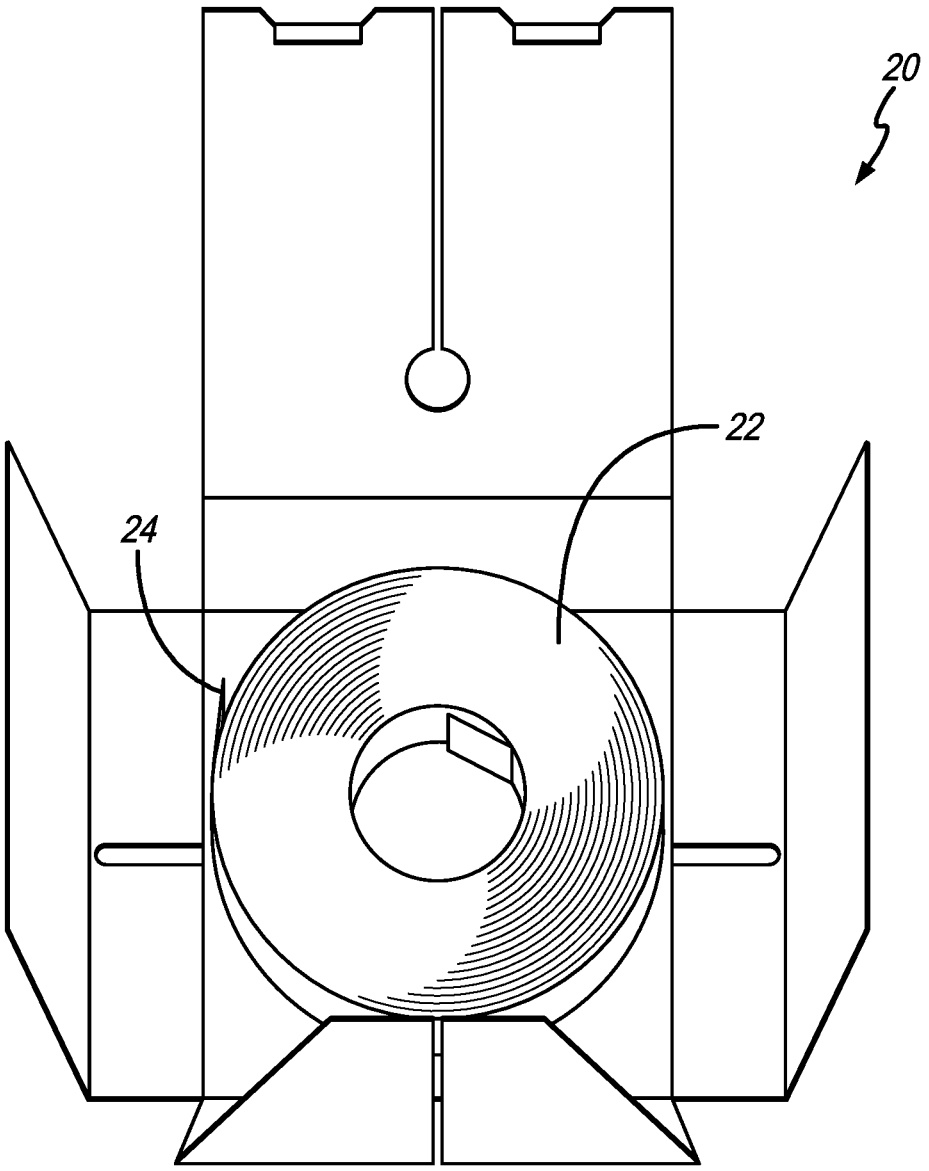
FIG. 2 PRIOR ART
FIG. 2 is a perspective view of the prior art cardboard box of FIG. 1, further illustrating the cardboard box in an open configuration exposing the tape ribbon therein.

As shown in the exemplary drawings for purposes of illustration, embodiments for a tape dispenser as disclosed herein are generally referred to in FIGS. 3-12 by reference numeral 26. In general, the tape dispenser 26 (e.g., a steel strap coil) as disclosed herein may be designed as a more permanent solution for carrying and dispensing the tape ribbon 22, especially when compared to the prior art cardboard box 20. More specifically, as illustrated in the perspective view of FIG. 3, the tape dispenser 26 as disclosed herein may generally include a housing 28 for generally retaining and dispensing the spiral wound tape ribbon 22 out from within the dispenser 26, a cap 30 for retaining and otherwise providing access to the tape ribbon 22 within the housing 28, a dispensing outlet 32 for convenient dispensing of the tape ribbon 22, and a set of safety walls 34, 36 shielding the sharp free end 24 of the tape ribbon 22 protruding from the dispensing outlet 32.

As shown best in FIGS. 5 and 7-10, the housing 28 may include a circular base plate 38, a circular outer sidewall 40 generally positioned at an outer perimeter of and perpendicular to the circular base plate 38, a circular inner sidewall 42 positioned within the outer sidewall 40 and perpendicular to the circular base plate 38, and an interior cavity 44 generally defined by the circular base plate 38, the outer sidewall 40, and the inner sidewall 42. Although, of course, the base plate 38, the outer sidewall 40, and the inner sidewall 42 may come in other shapes and/or sizes, including, e.g., being rectangular as opposed to circular. In this respect, the tape dispenser 26 in general may be circular, rectangular, or another shape or size compatible for use with the tape ribbon 22.

As shown in FIGS. 7-11, the dispensing outlet 32 may generally protrude outwardly and away from the outer sidewall 40 and may include an upper dispensing guide 46 generally offset from a lower dispensing wedge 48. The offset nature of the upper dispensing guide 46 and the lower dispensing wedge 48 forms a dispensing channel 50 therebetween and provides a channel to the interior cavity 44 for purposes of dispensing the tape ribbon 22 out from within the dispenser 26. The upper dispensing guide 46, the lower dispensing wedge 48, and the dispensing channel 50 may generally be bounded by a triangular shape, although the combination may form other shapes as may be known in the art. The dimensions of the dispensing outlet 32 may also vary to accommodate tape ribbons of varying widths, thicknesses, or shapes generally. The dispensing outlet 32 may aid in directing the flow of the tape ribbon 22 out from the tape dispenser 26.

The tape dispenser 26 as disclosed herein may also include a handle 52 for convenient hand grasping. For example, FIGS. 3 and 6-12 illustrate one embodiment of the handle 52 having an arcuate shape and generally extending out and away from the body of the tape dispenser 26. Although, the handle 52 could be any other shape known in the art to accommodate easy hand grasping and manipulation. In one embodiment, the handle 52 may couple to or otherwise be formed from the housing 28, such as part of a single piece of molded plastic.

Figure 5:
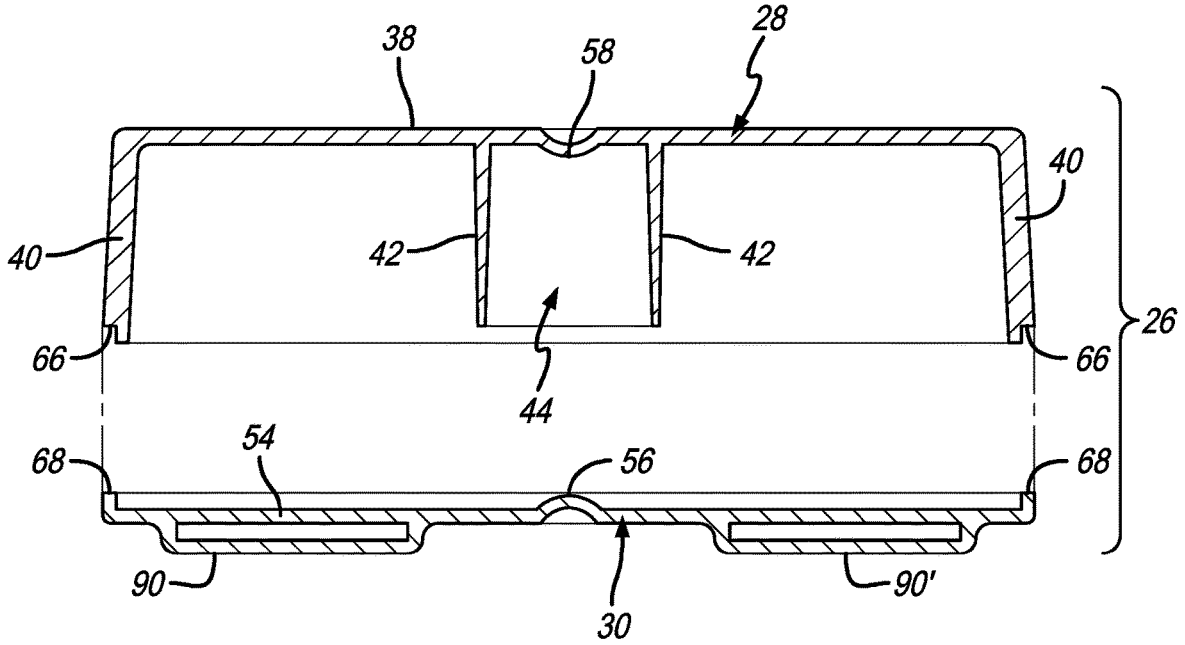
FIG. 5 is an exploded cross-sectional view of the tape dispenser taken about the line 5-5 in FIG. 3, further illustrating that the housing includes an internally located inner sidewall offset from an outer sidewall and cooperating therewith to form an interior cavity.

As best shown in the cross-sectional view of FIG. 5, the cap 30 may include a generally flat annular plate 54 having a central reinforcement rib 56 therein designed to enhance rigidity and otherwise reduce flexibility of the cap 30. The housing 28 may also include a similarly shaped inwardly projecting reinforcement rib 58 (e.g., opposite the central enforcement rib 56), which may also serve to enhance the rigidity and reduce flexibility of the housing 28. In some embodiments, the cap 30 may cooperate with the housing 28 to form the interior cavity 44 therein as bounded by each of the circular base plate 38, the inwardly projecting side walls 42, and the flat annular plate 54. Here, the interior cavity 44 may be used for storage or the like, and may be accessible by way of a lid that may be formed integral with the circular base plate 38 (e.g., slidable relative thereto) or that may otherwise pivot relative to the circular base plate 38 about a hinge designed to spring-bias the lid into a normal closed position to reduce the potential that items stored therein inadvertently fall out during use. Additionally, the inner cavity 44 may be generally cylindrically shaped and include a diameter relatively smaller than that of an open internal diameter of the tape ribbon 22, to permit the tape ribbon 22 to slide thereon to remain substantially wound there-around during storage and use.

Figure 6:
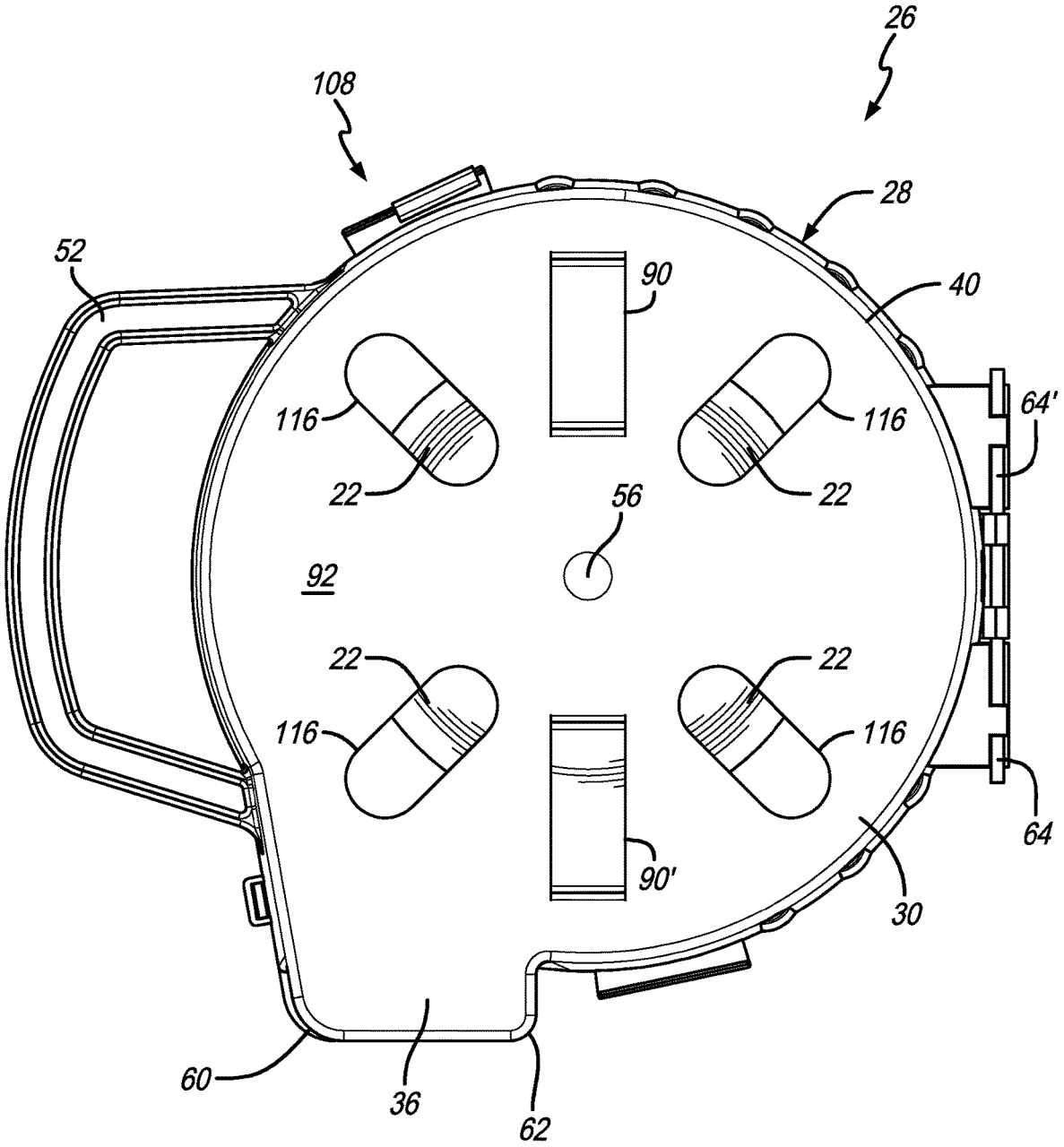
FIG. 6 is a top view of the tape dispenser with the cap thereon.
Figure 7:
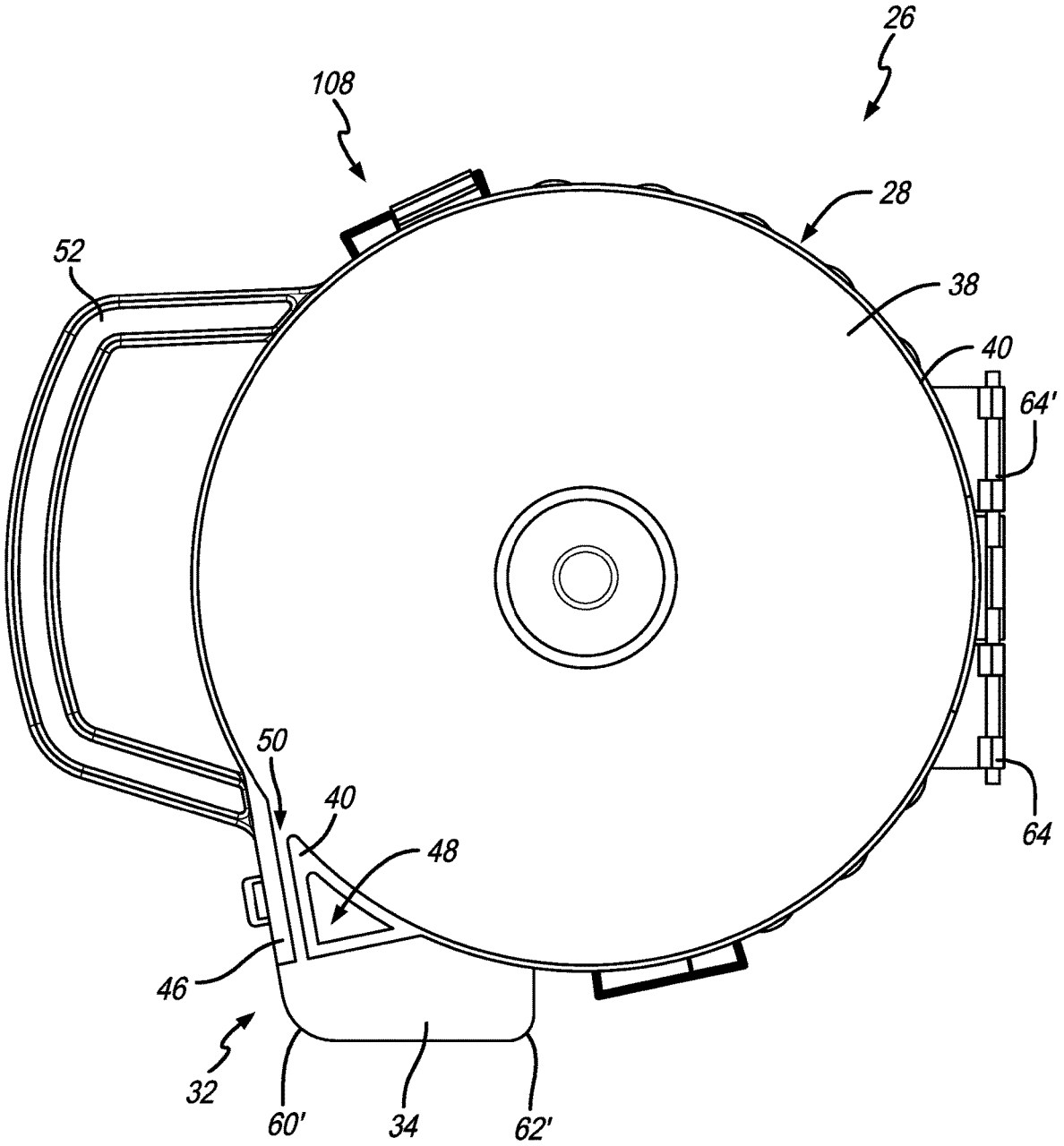
FIG. 7 is a top view of the tape dispenser with the cap removed, further illustrating the interior cavity and the dispensing outlet enclosed by the safety walls.
Figure 8:
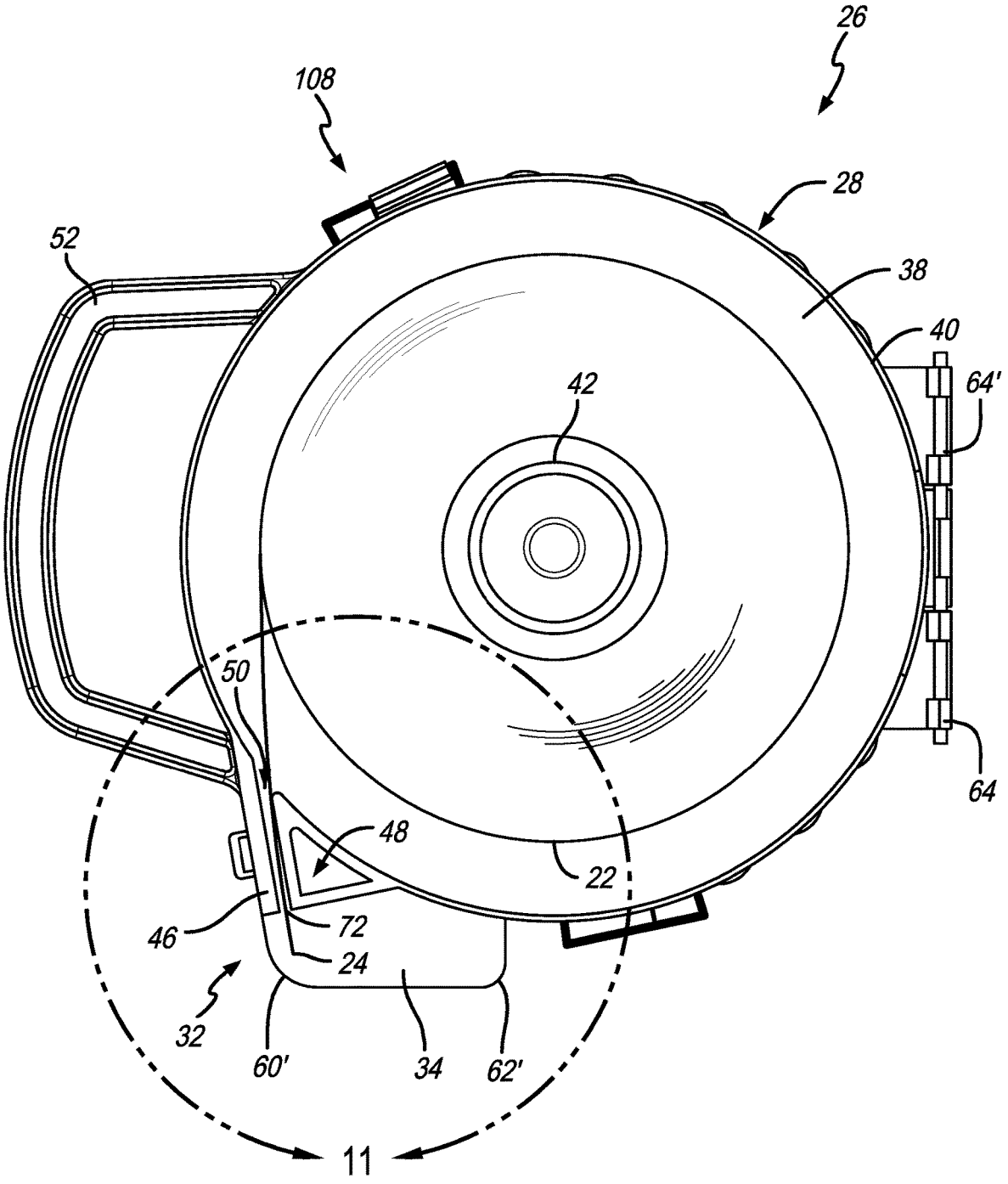
FIG. 8 is a top view of the tape dispenser similar to FIG. 7, further illustrating the tape ribbon generally spirally wrapped within the interior cavity around the inner sidewall and having a free end protruding out from the dispensing outlet and shielded by the safety walls.
Figure 9:
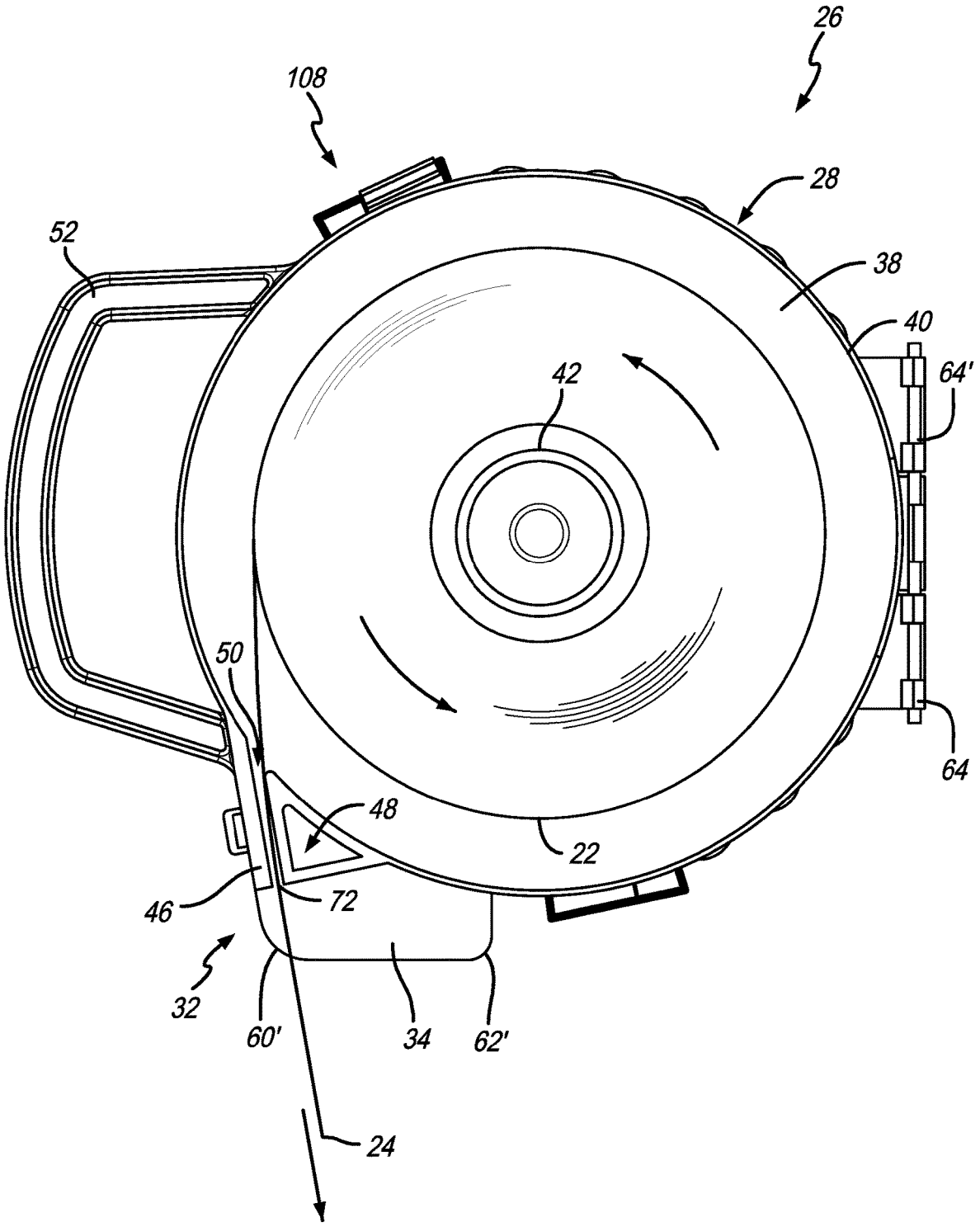
FIG. 9 is a top view similar to FIG. 8, further illustrating dispensing the tape ribbon by pulling on the free end.

As shown in FIGS. 3 and 6-12, the safety walls 34, 36 may generally integrally extend outwardly from the dispensing outlet 32. In one embodiment, the shape of the safety walls 34, 36 may be generally rectangular and include rounded edges, e.g., including a pair of upper fillets 60, 60' and a pair of lower fillets 62, 62'. In this respect, the generally rectangular shape and rounded/filleted edges give the safety walls 34, 36 a smooth shape or contour to enhance safety of the tape dispenser 26. More specifically, e.g., as illustrated in FIG. 6, the safety wall 36 is illustrated generally extending from and flush with the flat annular plate 54 of the cap 30. Additionally, as illustrated in FIGS. 7-10, the safety wall 34 may generally extend from and be flush with the circular base plate 38 of the housing 28. As shown best in FIG. 3, the safety walls 34, 36 may be sized to generally shield the dispensing outlet 32 when the cap 30 is placed on the housing 28, with the safety wall 36 positioned directly above the safety wall 34. To this end, e.g., as illustrated in FIG. 8, the safety walls 34, 36 cooperate to form an enclosure therebetween that provides an opening adjacent the dispensing outlet 32 where the free end 24 of the tape ribbon 22 may reside. In other words, the safety walls 34, 36 cooperate to house the free end 24 therebetween while generally providing a bumper buffer in the form of the upper fillets 60, 60' and the lower fillets 62, 62'.

Figure 3:
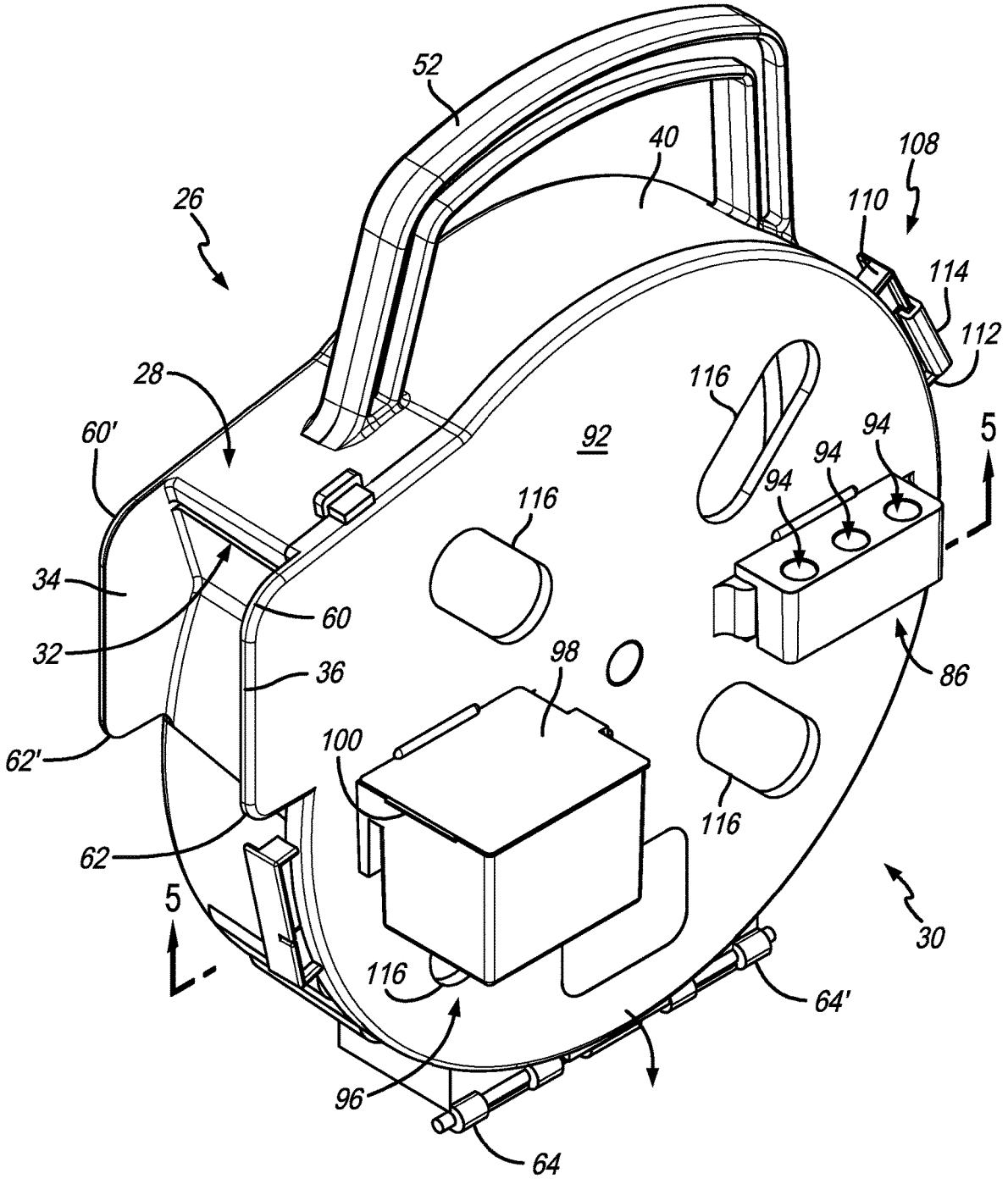
FIG. 3 is a perspective view of a tape dispenser as disclosed herein, including a housing and a cap that cooperate to form a pair of safety walls at a dispense outlet that shields a free end of the tape ribbon when not in use.
Figure 12:
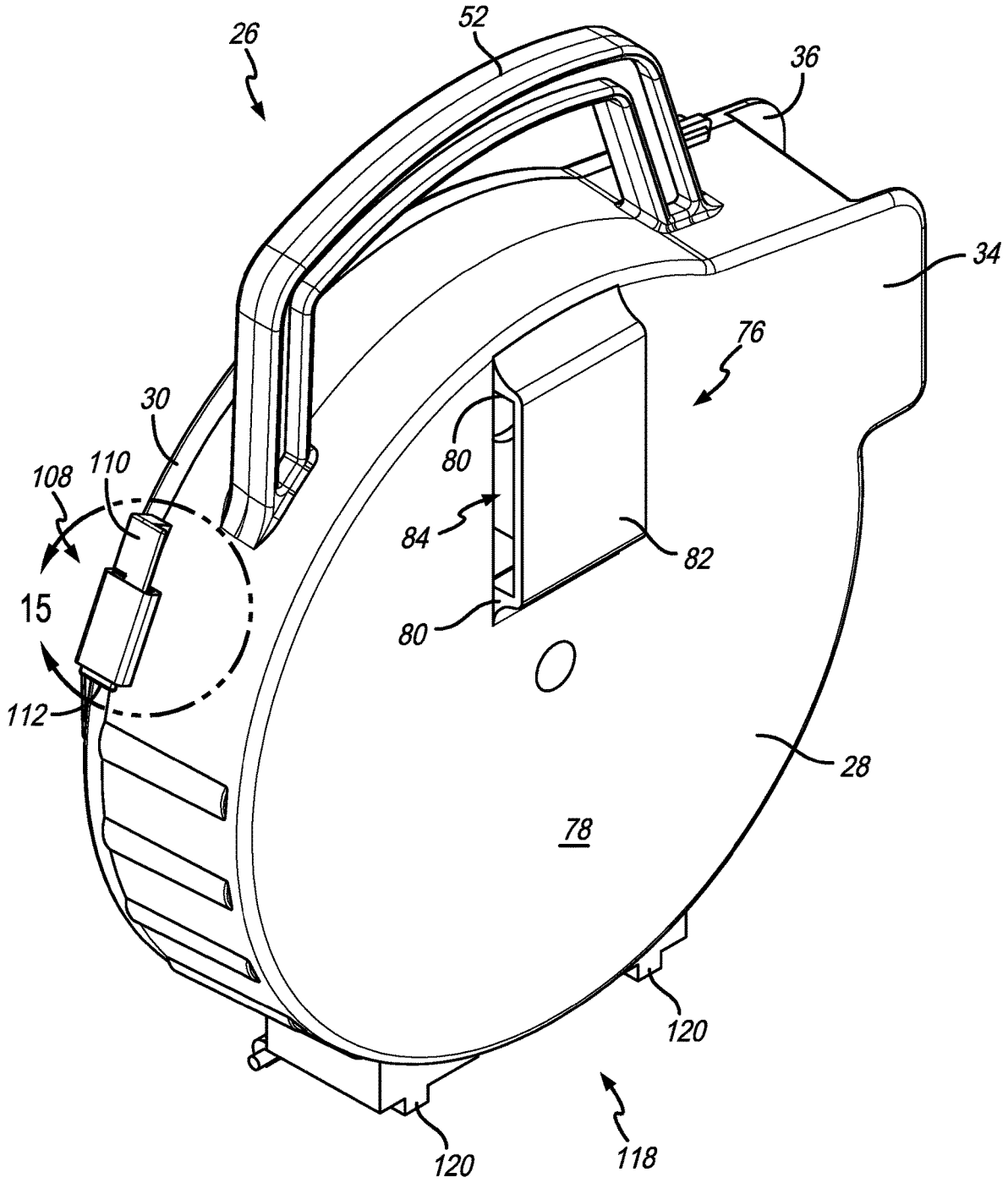
FIG. 12 is a rear perspective view of the tape dispenser, further illustrating a belt loop extending out from a rear surface of the housing.

In operation, starting with FIG. 8, the generally rectangular coiled tape ribbon 22 may be loaded into the tape dispenser 26 by sliding the tape ribbon 22 over the relatively smaller diameter and generally circular inner sidewall 42 of the housing 28. The free end 24 of the tape ribbon 22 may be pulled in between the upper dispensing guide 46 and the lower dispensing wedge 48 and through the dispensing channel 50 for external accessibility. The cap 30 may then be mated to the housing 28. In one embodiment, as best illustrated in FIG. 3, the cap 30 may couple to the housing 28 about a pair of hinges 64, 64'. As such, the cap 30 may pivot between a first open position (e.g., as illustrated in FIGS. 7-10) for purposes of inserting and/or removing the tape dispenser 22, including initially threading the free end 24 through the dispensing channel 50, and a second closed position (e.g., as illustrated in FIGS. 3, 6, and 12) for housing and transporting the tape dispenser 26 within the interior thereof. When in the second closed position, a circumferential underside notch 66 and a commensurately shaped upper lip 68 of the outer sidewall 40 may make contact to seal the cap 30 to the housing 28.

Figure 10:
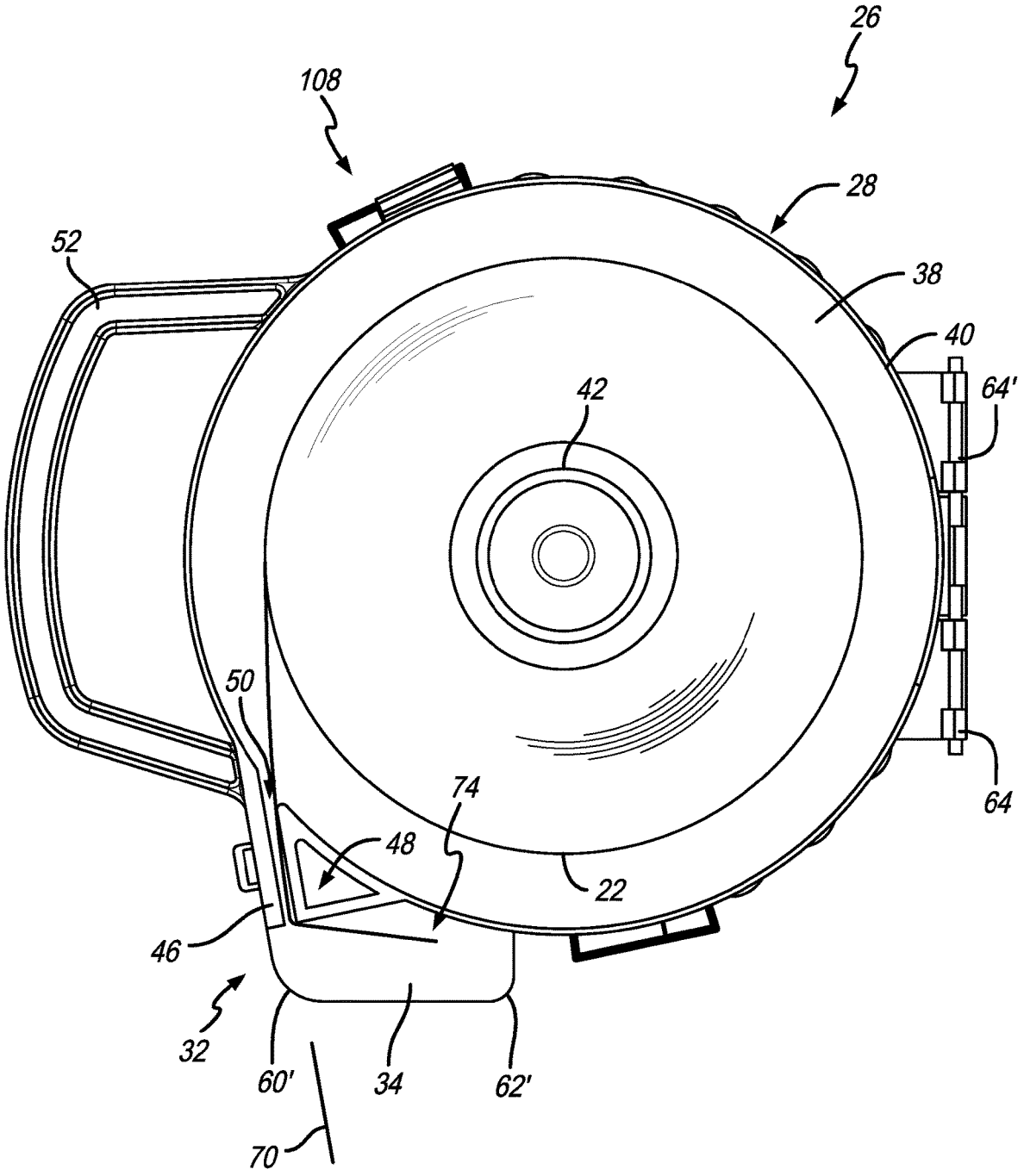
FIG. 10 is a top view similar to FIGS. 8 and 9, further illustrating a tape ribbon piece separated from the spiral wound tape ribbon within the interior cavity, thereby leaving behind a new free end of the tape ribbon bent within and shielded by the enclosure of the safety walls.
Figure 11:
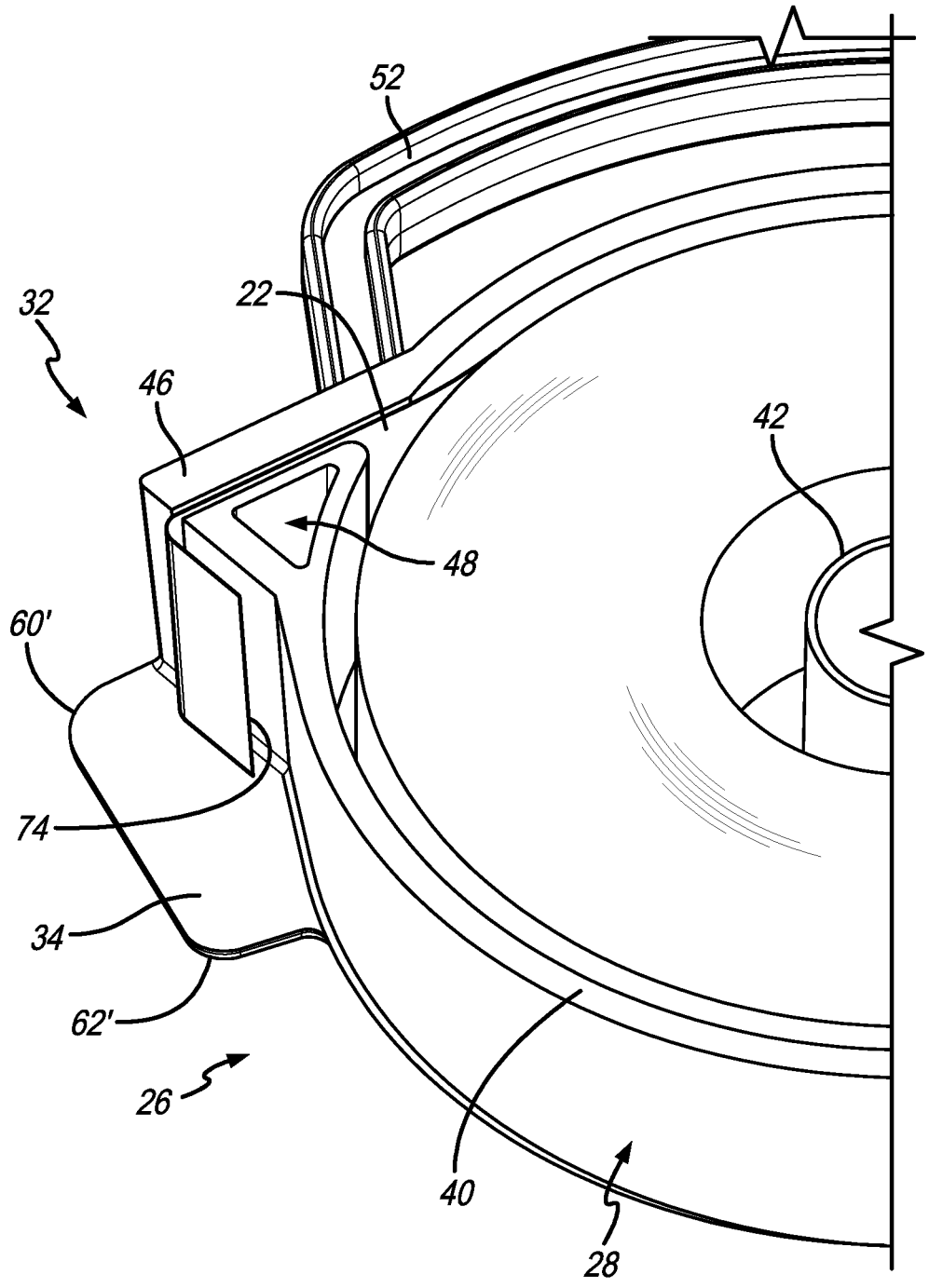
FIG. 11 is an enlarged top perspective view of the housing of the tape dispenser taken about the circle 11 in FIG. 8, further illustrating the tape ribbon wrapped around the inner sidewall and having the free end thereof protruding out through the dispensing outlet and shielded on one side by one of the safety walls.

As best illustrated in FIG. 8, the free end 24 of the tape ribbon 22 may protrude out of the dispensing outlet 32 yet remain behind each of the safety walls 34, 36. While in this position, the free end 24 is still hand accessible within the enclosure formed by the safety walls 34, 36, despite being generally shielded from inadvertent contact therein. The user may then dispense the tape ribbon 22 from the tape dispenser 26 by inserting part of the hand or a finger into the enclosure formed by the safety walls 34, 36 and the outer sidewall 40 of the housing 28, to grasp and pull the free end 24 outwardly away from the housing 28. This causes the tape ribbon 22 to unwind about the inner sidewall 42 of the housing 28, thereby allowing the tape ribbon 22 to extend out beyond the safety walls 34, 36. Here, as illustrated best in FIG. 9, the free end 24 is externally accessible for easy hand manipulation, e.g., for cutting. In this respect, FIG. 10 illustrates that the tape ribbon 22 has been cut such that a tape ribbon piece 70 has been removed from the relatively larger stock of the tape ribbon 22. Of course, at this point, the tape ribbon piece 70 may be used for construction or otherwise.

In one embodiment, the user may cut the tape ribbon piece 70 from the tape ribbon 22 by scissors or another cutting device known in the art. Alternatively, the tape ribbon 22 may be cut by an integrated scissor 72 built into and contained or hidden within the tape dispensing outlet 32 by, e.g., the safety walls 34, 36. In this respect, the user may cut the tape ribbon 22 with the integrated scissor 72 by applying a sufficient cutting force at the exit of the dispensing outlet 32 to permit opposing jaws of the integrated scissor 72 to come down upon and cut the tape ribbon piece 70 from the tape ribbon 22. In another aspect of this embodiment, the tape ribbon piece 70 may detach automatically from the remainder of the tape ribbon 22 once pulled with sufficient force (e.g., at a length that causes engagement with the integrated scissor 72). As shown in FIG. 10, once the tape ribbon piece 70 is cut, a new free end 74 of the tape ribbon 22 may continue to reside within the interior of the enclosure formed by the safety walls 34, 36. If desired, the user may bend the new free end 74 of the tape ribbon 22 inwardly (and about the lower dispensing wedge 48) into a non-use position as illustrated in FIG. 10. Here, the typically sharp new free end 74 is shielded from accidental contact, while also preventing the new free end 74 from winding back into the interior of the tape dispenser 26 and behind the safety walls 34, 36.

In another embodiment, FIG. 12 illustrates that the tape dispenser 26 may include a belt loop 76 generally projecting outwardly from a rear surface 78 of the housing 28. The belt loop 76 may be essentially formed by a pair of angled extenders 80 extending outwardly from the rear surface 78 that terminate into a baseplate 82 generally connecting the two extenders 80 and generally positioned parallel to the rear surface 78. The angled extenders 80 and the baseplate 82 cooperate with the rear surface 78 to form a relatively elongated through channel 84 having a size and shape to accommodate slide through reception and retention of a belt or the like. During use (e.g., when the tape dispenser 26 is worn on a belt), the interior cavity 44 may still be accessed for purposes of inserting and/or replacing the tape dispenser 26 without removal from the belt loop by unlocking (FIG. 15) and pivoting the cap 30 about the hinges 64, 64' relative to the housing 28.

Figure 4:
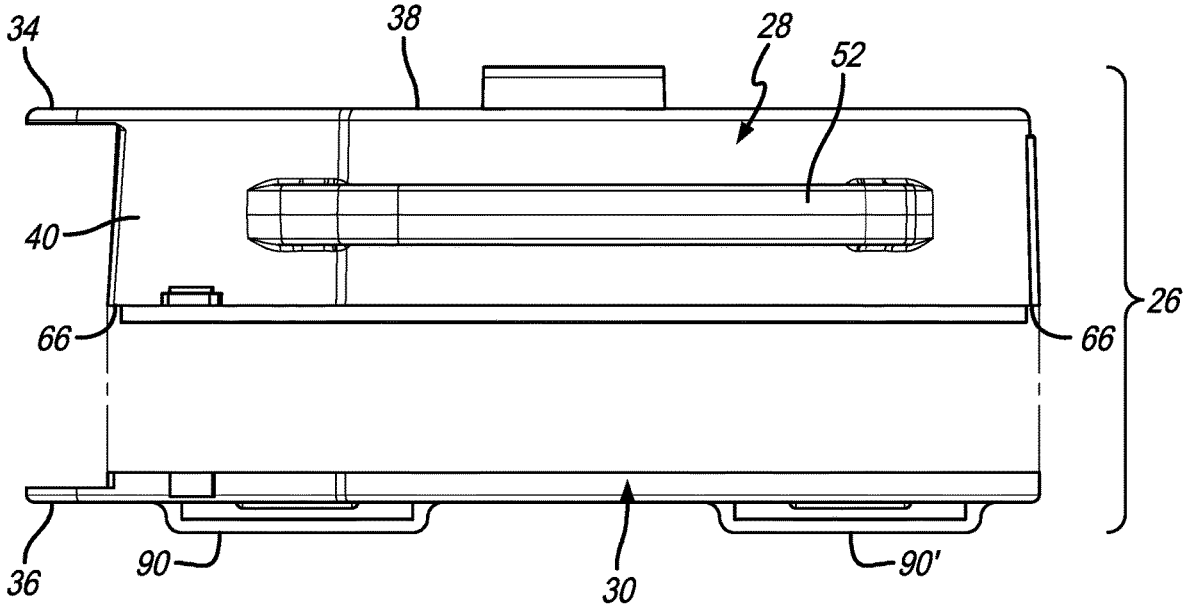
FIG. 4 is an exploded side view of the tape dispenser of FIG. 3, further illustrating the cap in exploded relation relative to the housing.
Figure 13:
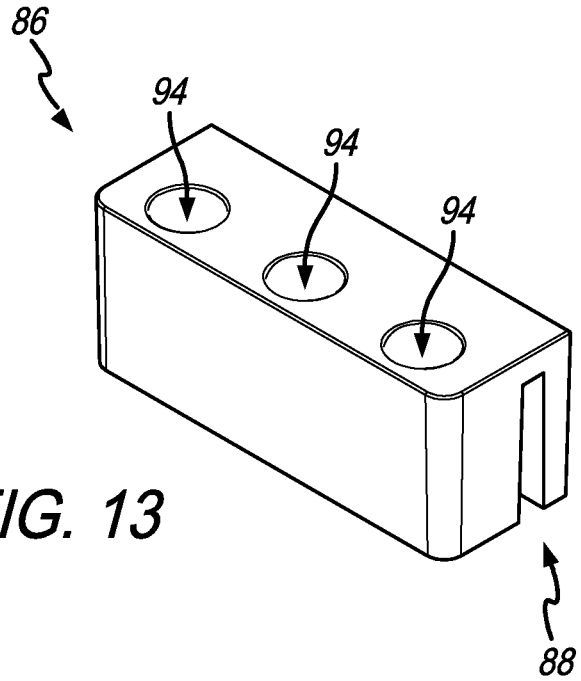
FIG. 13 is a perspective view of a nutsetter carrier configured for select engagement and retention by the tape dispenser.

In another aspect of the embodiments disclosed herein, FIG. 13 illustrates a perspective view of a nutsetter carrier 86 that includes a generally u-shaped slot 88 having a size and shape to selectively engage and be retained within one or more accessory receptacles 90 projecting outwardly from a front surface 92 of the cap 30 (FIGS. 4-6). The u-shaped slot 88 may slide onto one of the accessory receptacles 90 for friction fit engagement therewith and be positioned such that one or more apertures 94 therein remain in a substantially upright position to selectively receive and retain nutsetter accessories therein. Although, of course, u-shaped slot 88 may also engage the accessory receptacle 90 by snap-fit engagement or the like.

Figure 14:
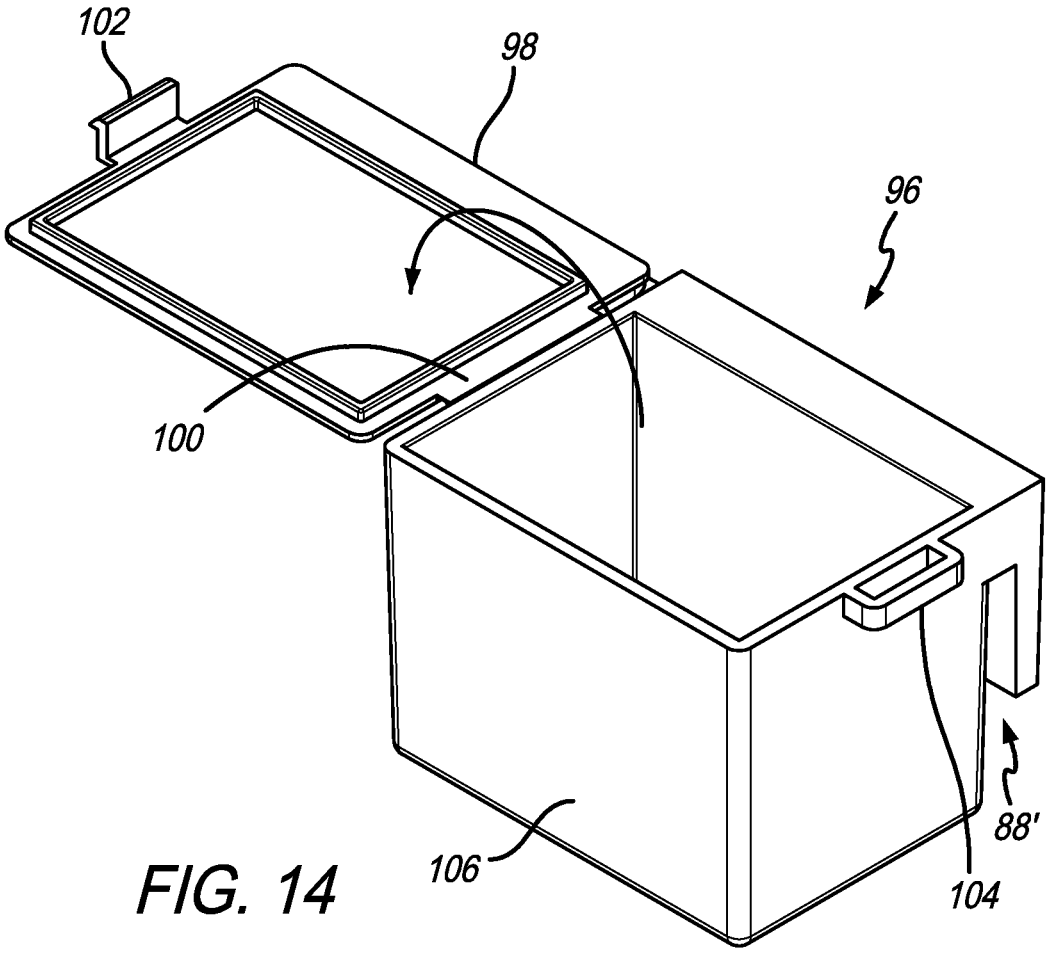
FIG. 14 is a perspective view of an accessory compartment in an open position, configured for select engagement and retention by the tape dispenser.

In another aspect of the embodiments disclosed herein, the accessory receptacles 90 may be configured to selectively retain an accessory compartment 96, e.g., as illustrated in a closed position in FIG. 3 and in an open position in FIG. 14, such as by way of engagement of a similar u-shaped slot 88'. The accessory compartment 96 is externally accessible and may store tools or hardware such as screws, bolts, nuts, etc. The accessory compartment 96 may include a lid 98 coupled to a hinge 100 for securing contents within the accessory compartment 96, such as by snap-fit engagement of a detent 102 with a receptacle 104. The hinge 100 may be fixed to a bucket portion 106, and the lid 98 may be pivotally attached to the hinge 100. The lid 98 may rotate about the hinge 100 to seal the accessory compartment 96 when, e.g., the detent 102 of the lid 98 engages the receptacle 104 of the bucket portion 106.

Figure 15:
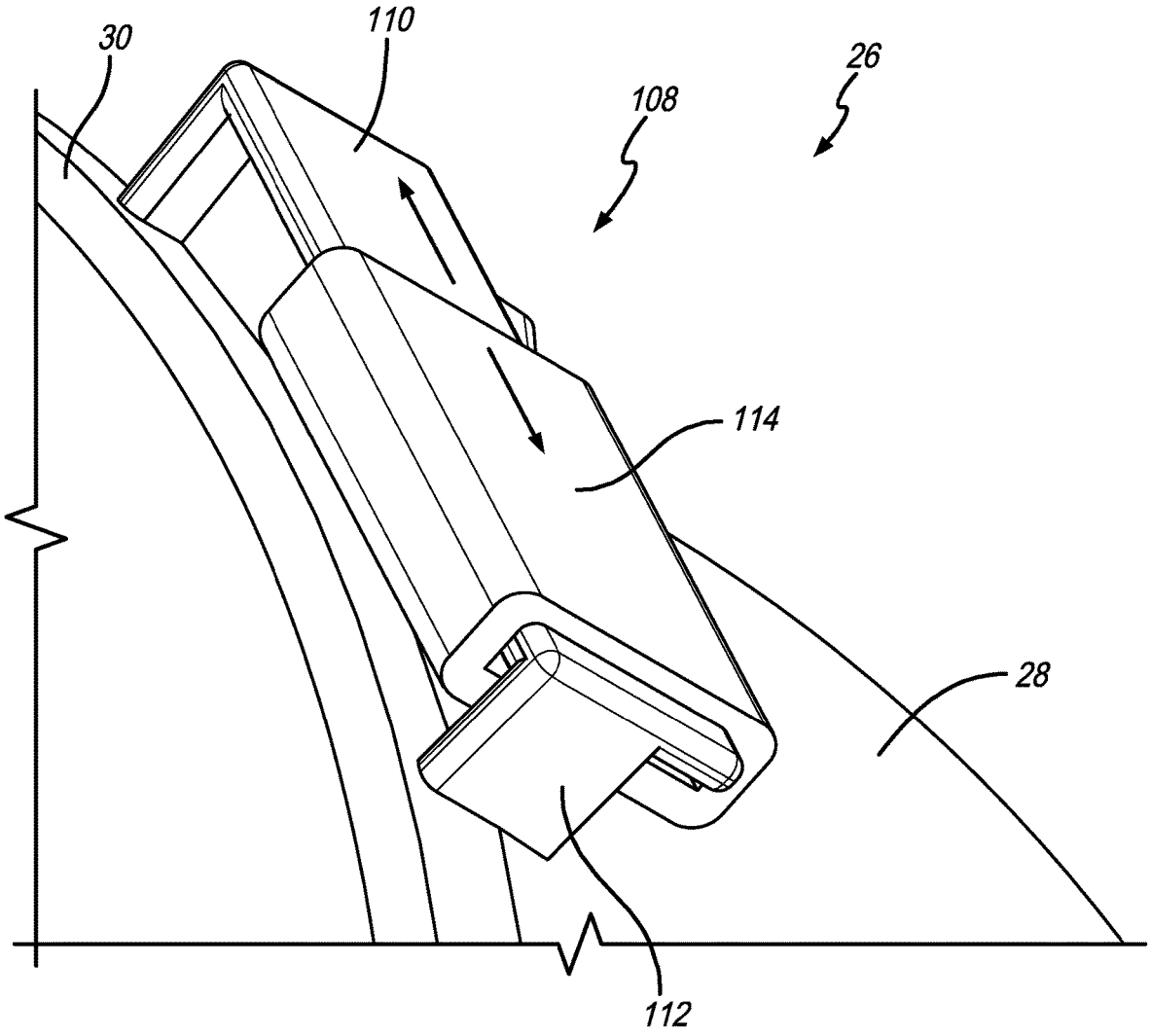
FIG. 15 is an enlarged perspective view taken about the circle 15 in FIG. 12, illustrating engagement of a slide lock that selectively retains the cap to the housing.

In another aspect of the embodiments disclosed herein, as best illustrated in FIGS. 3 and 15, the cap 30 and the housing 28 may include a slide lock 108 for locking the cap 30 relative to the housing 28 during use. In one embodiment, the slide lock 108 may generally include a pair of keyed interfacing locking channels 110, 112 formed from each of the housing 28 and the cap 30. When the cap 30 of the tape dispenser 26 is in the closed position (e.g., as illustrated in FIG. 3), each of the interfacing locking channels 110, 112 may form a T-shaped cross-section configured to receive a slide 114 thereon having a reciprocal structure designed to encompass the outer surface area of the T-shaped cross-section of the mated interfacing locking channels 110, 112. When the cap 30 is in the closed position, the cap 30 may be locked to the housing 28 by moving the slide 114 from a disengaged position, whereby the body of the slide 114 is in a generally non-overlapping position with at least one of the locking channels 110 or 112, to an engaged position, whereby the body of the slide 114 moves to a generally overlapping position wherein the slide 114 encompasses both of the locking channels 110 and 112. When in this position, one locking channel cannot pull away from the other locking channel, effectively locking the cap 30 relative to the housing 28.

In another aspect of the embodiments disclosed herein, the cap 30 may include one or more windows 116 extending radially outwardly from about the inner sidewall 42 to about the outer sidewall 42, which allow the user to monitor the quantity of the tape ribbon 22 that remains within the tape dispenser 26 without the need to physically open the tape dispenser 26 to look inside. For example, FIG. 3 illustrates one scenario where the tape dispenser 26 is empty. As such, each of the windows 116 permit viewing into the interior cavity 44 thereof such that the user can see in FIG. 3 that the tape dispenser 26 does not contain the tape ribbon 22. Alternatively, as illustrated in FIG. 6, the tape dispenser 26 includes a quantity of the tape ribbon 22 visible out from within each of the windows 116. Here, the user may monitor the quantity of the tape ribbon 22 within the tape dispenser 26 during use. That is, continued dispensing of the tape ribbon 22 out from within the tape dispenser 26 results in a decreased amount of material visible through the windows 116. This way, a user may easily determine when the tape ribbon 22 needs replacement.

Furthermore, FIG. 12 illustrates that the tape dispenser 26 may also include a generally flat base 118 integrated as part of the housing 28 and/or the cap 30 opposite the handle 52. As best illustrated in FIG. 12, the base 118 extends about a width of the tape dispenser 26 by a distance sufficient to provide landing support that allows a user to set the tape dispenser 26 down on a relatively flat surface such that the tape dispenser 26 remains in an upright or vertical position (e.g., in the orientation generally illustrated in FIG. 3 or 12). Of course, the width of the base 118 may vary depending on the embodiment, but should be wide enough to provide support for the tape dispenser 26, especially when carrying a full roll of the tape ribbon 22. To this end, the base 118 may include a pair of downwardly projecting feet 120 which provide additional support thereto, for purposes of ensuring that the tape dispenser 26 remains in the upright or vertical position when using the base 118 as a stand during non-use.

Although several embodiments have been described in detail for purposes of illustration, various modifications may be made without departing from the scope and spirit of the invention. Accordingly, the invention is not to be limited, except as by the appended claims.

What is claimed is:

1. A dispenser, comprising:

a housing having an inner cavity for select reception and retention of a tape ribbon, wherein a lower base plate of the housing cooperates with an upstanding and generally circular-shaped inner sidewall positioned to an interior of an upstanding and generally circular-shaped outer sidewall to form the inner cavity in the housing;

a cap movable between a closed position enclosing the inner cavity and an open position providing access to the inner cavity in the housing;

a dispense channel comprising an upper guide offset from a lower wedge by a distance relatively larger than a material thickness of the tape ribbon to permit unwinding removal of the tape ribbon out from within the inner cavity when the cap is in the closed position; and a safety wall extending outwardly from the dispense channel and forming an enclosure shielding opposite sides of a free end of the tape ribbon extending through the dispense channel, while permitting front on hand access of the free end for continued select dispensing.

2. The dispenser of claim 1, wherein the safety wall comprises a pair of outwardly extending and oppositely facing safety walls on each side of the dispense channel that cooperate with an outer sidewall of the housing having the dispense channel formed therein to generally form a three sided-pocket comprising the enclosure.

3. The dispenser of claim 1, wherein the lower wedge includes a ledge about which a portion of the tape ribbon may be bent for storage of the free end within the enclosure during non-use.

4. The dispenser of claim 1, wherein the lower wedge extends outwardly away from the outer sidewall and includes an integrated cutting edge.

5. The dispenser of claim 1, wherein the housing includes a handle for carrying the tape ribbon within the dispenser.

6. The dispenser of claim 1, wherein the cap includes at least one accessory receptacle configured to engage a generally U-shaped slot of an accessory compartment.

7. The dispenser of claim 1, wherein the cap includes a circumferential lip having a size and shape for engagement with a circumferential notch in an outer sidewall of the housing when the cap is in the closed position.

8. The dispenser of claim 1, wherein the housing includes a belt loop comprising a pair of angled extenders outwardly extending from a rear surface of the housing and terminating in a generally horizontally positioned base plate interconnecting the angled extenders and forming a through channel underneath to accommodate slide through reception of a belt.

9. The dispenser of claim 1, including a lock for retaining the cap in the closed position relative to the housing.

10. The dispenser of claim 9, wherein the lock comprises a pair of T-shaped channels formed from each of the housing and the cap and keyed for linear alignment when the cap is in the closed position such that a slide lock having a reciprocal structure for at least partially encompassing the T-shaped channels can move between a first unlocked position whereby the slide lock is in a generally non-overlapping position with at least one of the T-shaped channels and a second locked position whereby the slide lock is in a generally overlapping position with respect to both of the locking channels.

11. The dispenser of claim 1, including at least one radially outwardly extending elongated window formed from the housing or the cap permitting viewing of the inner cavity when the cap is in the closed position.

12. The dispenser of claim 1, including a base having a pair of feet downwardly extending therefrom and providing support to stand the dispenser in a generally vertical position during non-use.

13. A dispenser, comprising:

a housing configured for select reception and retention of a tape ribbon, wherein a lower base plate of the housing cooperates with an upstanding and generally circular-shaped inner sidewall positioned to an interior of the upstanding and generally circular-shaped outer sidewall to form an inner cavity for retaining the tape ribbon within the housing;

a cap movable between a closed position enclosing the tape ribbon within the housing and an open position providing access to the tape ribbon in the housing;

a dispense channel comprising a guide offset from a wedge by a distance relatively larger than a material thickness of the tape ribbon, thereby permitting unwinding removal of the tape ribbon out from within the housing through the dispense channel when the cap is in the closed position; and a pair of outwardly extending and oppositely facing safety walls on each side of the dispense channel that cooperate with an outer sidewall of the housing having the dispense channel formed therein to generally form a three sided-pocket shielding opposite sides of a free end of the tape ribbon extending through the dispense channel, while permitting front on hand access of the free end for continued select dispensing.

14. The dispenser of claim 13, wherein the wedge extends outwardly away from the outer sidewall and includes an edge about which a portion of the tape ribbon may be bent for storage within the three-sided pocket during non-use.

15. The dispenser of claim 13, wherein the cap includes a circumferential lip having a size and shape for engagement with a circumferential notch in the outer sidewall of the housing when the cap is in the closed position.

16. The dispenser of claim 13, including a lock comprising a pair of T-shaped channels formed from each of the housing and the cap and keyed for linear alignment when the cap is in the closed position such that a slide lock having a reciprocal structure for at least partially encompassing the T-shaped channels can move between a first unlocked position whereby the slide lock is in a generally non-overlapping position with at least one of the T-shaped channels and a second locked position whereby the slide lock is in a generally overlapping position with respect to both of the locking channels.

17. A dispenser, comprising:

a housing for selectively storing and dispensing a tape ribbon therefrom;

a cap movable relative to the housing between an open position and a closed position where a lip of the cap engages a notch in an outer sidewall of the housing;

a dispense channel having a size and shape for selectively dispensing the tape ribbon from the housing when the cap is in the closed position;

a safety wall extending outwardly from the dispense channel and forming an enclosure shielding opposite sides of a free end of the tape ribbon extending through the dispense channel, while permitting front on hand access of the free end for continued select dispensing; and a lock comprising a pair of channels formed in each of the housing and the cap and keyed for linear alignment with one another when the cap is in the closed position such that a slide is movable between a first unlocked position in generally non-overlapping relation with respect to at least one of the pair of channels and a second locked position whereby the slide generally overlaps each of the pair of locking channels.

18. The dispenser of claim 17, wherein the safety wall comprises a pair of outwardly extending and oppositely facing safety walls on each side of the dispense channel, which comprises an upper dispensing guide offset from a lower dispensing wedge by a distance relatively larger than a material thickness of the tape ribbon, to permit unwinding removal of the tape ribbon out from within the housing and that cooperates with the outer sidewall of the housing having the dispense channel formed therein to generally form a three sided-pocket comprising the enclosure.

19. The dispenser of claim 18, wherein the lower dispensing wedge includes a ledge about which a portion of the tape ribbon may be bent for storage of the free end within the enclosure during non-use and a lower base plate of the housing cooperates with an upstanding and generally circular-shaped inner sidewall positioned to an interior of the outer sidewall to form an inner cavity in the housing.

20. The dispenser of claim 18, wherein the lower dispensing wedge extends outwardly away from the outer sidewall, the cap includes at least one accessory receptacle configured to engage a generally U-shaped slot of an accessory compartment comprising at least a nutsetter carrier, and the housing includes a handle for carrying the tape ribbon within the dispenser and a belt loop comprising a pair of angled extenders outwardly extending from a rear surface of the housing and terminating in a generally horizontally positioned base plate interconnecting the angled extenders and forming a through channel underneath to accommodate slide through reception of a belt.

21. A dispenser, comprising:

a housing having an inner cavity for select reception and retention of a tape ribbon;

a cap movable between a closed position enclosing the inner cavity and an open position providing access to the inner cavity in the housing, wherein the cap includes at least one accessory receptacle configured to engage a generally U-shaped slot of an accessory compartment;

a dispense channel having a size and shape for selectively dispensing the tape ribbon out from within the inner cavity when the cap is in the closed position; and a safety wall extending outwardly from the dispense channel and forming an enclosure shielding opposite sides of a free end of the tape ribbon extending through the dispense channel, while permitting front on hand access of the free end for continued select dispensing.

22. A dispenser, comprising:

a housing having an inner cavity for select reception and retention of a tape ribbon;

a cap movable between a closed position enclosing the inner cavity and an open position providing access to the inner cavity in the housing;

a dispense channel having a size and shape for selectively dispensing the tape ribbon out from within the inner cavity when the cap is in the closed position;

a safety wall extending outwardly from the dispense channel and forming an enclosure shielding opposite sides of a free end of the tape ribbon extending through the dispense channel, while permitting front on hand access of the free end for continued select dispensing; and a lock for retaining the cap in the closed position relative to the housing, wherein the lock comprises a pair of T-shaped channels formed from each of the housing and the cap and keyed for linear alignment when the cap is in the closed position such that a slide lock having a reciprocal structure for at least partially encompassing the T-shaped channels can move between a first unlocked position whereby the slide lock is in a generally non-overlapping position with at least one of the T-shaped channels and a second locked position whereby the slide lock is in a generally overlapping position with respect to both of the locking channels.

23. A dispenser, comprising:

a housing configured for select reception and retention of a tape ribbon;

a cap movable between a closed position enclosing the tape ribbon within the housing and an open position providing access to the tape ribbon in the housing;

a dispense channel comprising a guide offset from a wedge by a distance relatively larger than a material thickness of the tape ribbon, thereby permitting unwinding removal of the tape ribbon out from within the housing through the dispense channel when the cap is in the closed position;

a pair of outwardly extending and oppositely facing safety walls on each side of the dispense channel that cooperate with an outer sidewall of the housing having the dispense channel formed therein to generally form a three sided-pocket shielding opposite sides of a free end of the tape ribbon extending through the dispense channel, while permitting front on hand access of the free end for continued select dispensing; and a lock comprising a pair of T-shaped channels formed from each of the housing and the cap and keyed for linear alignment when the cap is in the closed position such that a slide lock having a reciprocal structure for at least partially encompassing the T-shaped channels can move between a first unlocked position whereby the slide lock is in a generally non-overlapping position with at least one of the T-shaped channels and a second locked position whereby the slide lock is in a generally overlapping position with respect to both of the locking channels.

* * * * *